United States Patent [19]

Mueller et al.

[11] 4,215,987

[45] Aug. 5, 1980

[54] PROCESS FOR CHEMICALLY IMPARTING A DURABLE, MULTIPLE-LEVEL, PILE HEIGHT TO TERRY TOWELLING, TERRY FABRIC AND CUT PILE COTTON FABRIC

[75] Inventors: K. Karl Mueller, Armonk, N.Y.; Christopher J. Lupton, Lubbock, Tex.

[73] Assignee: Cotton Incorporated, New York, N.Y.

[21] Appl. No.: 968,258

[22] Filed: Dec. 11, 1978

[51] Int. Cl.[2] ..... D06P 5/00

[52] U.S. Cl. ..... 8/115; 8/929

[58] Field of Search ..... 8/17, 115

[56] References Cited

U.S. PATENT DOCUMENTS

| | | | |
|---|---|---|---|
| 1,804,529 | 5/1931 | Dreyfus | 8/17 |
| 2,020,698 | 11/1935 | Platt | 8/115 |
| 2,110,866 | 3/1938 | Castles | 8/17 |
| 2,531,814 | 11/1950 | Heberlein et al. | 8/115 |
| 3,849,159 | 11/1974 | Palmer et al. | 8/17 |
| 3,901,649 | 8/1975 | Gregorian et al. | 8/115 |
| 3,953,164 | 4/1976 | Boba et al. | 8/115 |
| 3,989,448 | 11/1976 | Bohrn | 8/115 |
| 4,108,597 | 8/1978 | Mueller et al. | 8/115 |

*Primary Examiner*—Maurice J. Welsh

*Attorney, Agent, or Firm*—Burns, Doane, Swecker & Mathis

[57] ABSTRACT

A durable, multiple-level, pile height is imparted to at least one surface of terry towelling, terry fabric or cut pile cotton fabric by treating the piles in predetermined areas of the surface with caustic paste and allowing the material to stand, with or without heating, so as to shrink and reduce the height of the caustic treated piles. The viscosity, the penetration period, and the manner of applying the paste are selected such that the ground layer of the material is substantially unaffected. The process is compatible with various dyeing techniques to obtain attractive color effects.

12 Claims, No Drawings

PROCESS FOR CHEMICALLY IMPARTING A DURABLE, MULTIPLE-LEVEL, PILE HEIGHT TO TERRY TOWELLING, TERRY FABRIC AND CUT PILE COTTON FABRIC

BACKGROUND OF THE INVENTION

1. Field of the Invention

This invention relates to a process for chemically imparting a durable, multiple-level, pile height on at least one surface of terry towelling, terry fabric or cut pile cotton fabric.

2. Description of the Prior Art

The production of multiple-level pile height material has typically been accomplished by either Jacquard weaving or by a shearing process. In either of these two known techniques, the necessary equipment is relatively complex, thereby requiring the attention of skilled technicians and a substantial investment to both construct and operate the equipment. While the art has long recognized that cellulosic fabrics may be treated with chemical agents, a process for chemically preparing a commercially acceptable material with multiple-level pile height has heretofore not been known.

Typical of the known processes for chemically treating a non-pile cellulosic fabric, particularly cotton fabric, is the so-called mercerization technique wherein a caustic agent is used to shrink and thus strengthen the cellulosic fibers. A caustic agent may also be applied to predetermined areas of an untreated or mercerized cellulosic fabric to obtain localized shrinking and thus an ornamental effect. This latter type of process is described in U.S. Pat. No. 2,531,814. An improved modification of this technique is set forth in U.S. Pat. No. 4,108,597.

It is also known in the art to treat pile fabrics with a chemical agent. For example, U.S. Pat. No. 1,804,529 describes a method of obtaining ornamental effects on fabrics, including pile fabrics, containing an organic substitution derivative (e.g., an ester) of cellulose. The ornamental effects are obtained by treating local areas of the fabric with an alkaline paste to saponify the derivative to reconstituted cellulose, carbonizing the reconstituted cellulose, and removing the carbonized cellulose. A similar technique is disclosed in U.S. Pat. No. 2,020,698.

A further example of a chemical treatment process is set forth in U.S. Pat. No. 2,110,866. The patent describes a process for preparing a pile fabric having a plurality of pile heights. The process comprises treating predetermined areas of the fabric with a paste comprising a shrinking agent (e.g., sodium hydroxide) and then heating, washing, and drying the fabric. The resulting fabric is useful in upholstery manufacture and for decorative purposes.

U.S. Pat. No. 3,849,159 relates to another process for chemically shrinking nylon pile fabric in predetermined areas to impart an embossed effect to the fabric via a process which involves the application of a thickened shrinking agent to selected areas of the piles by conventional printing techniques. The treated fabric may be heated, washed, and dried. In this regard, also see U.S. Pat. Nos. 3,901,649, 3,953,164 and 3,989,448.

Although the above-mentioned patents disclose processes for treating certain pile fabrics, such as carpeting or upholstery, with various shrinking agents, the search has continued for a process for chemically imparting commercially acceptable, durable, multiple-level, pile height to at least one surface of terry towelling, terry fabrics or cut pile cotton fabrics. The present invention was developed as a result of that search.

OBJECTS AND SUMMARY OF THE INVENTION

Accordingly, it is a general object of the present invention to eliminate or substantially alleviate the problems of the prior art.

A more specific object of the present invention is to provide a process for chemically imparting a durable, multiple-level, pile height to at least one surface of terry towelling, terry fabric or cut pile cotton fabric.

It is another object of the present invention to provide a process for imparting a durable, multiple-level, pile height to terry towelling, terry fabric or cut pile cotton fabric by contacting predetermined areas of the pile with a caustic paste, the viscosity of the paste, the manner of applying the paste and the contact time being selected to shrink the pile in the predetermined areas in the absence of substantial shrinkage of the ground layer.

It is a further object of the present invention to provide a process for chemically imparting a durable, multiple-level, pile height to terry towelling, terry fabric or cut pile cotton fabric, the chemically shrunken, shorter pile being a contrasting color from the unshrunken, larger piles.

Other objects and advantages of the present invention will become apparent from the following summary and description of the preferred embodiments of the present invention.

In one aspect, the present invention provides a process for imparting a durable, multiple-level, pile height to bleached, unbleached or dyed material selected from the group consisting of terry towelling, terry fabric and cut pile cotton fabric, said material having a ground layer supporting on at least one of its faces, a surface layer of piles. The process comprises:

(a) applying a caustic paste to at least one predetermined area of one of the surface layers of piles;

(b) allowing the caustic paste sufficient time to shrink the piles in said at least one predetermined area in the absence of substantial shrinkage of the ground layer; and (c) recovering the material.

In a further aspect, the present invention provides a process for imparting a durable, multiple-level, multiple-color pile height to bleached or dyed material selected from the group consisting of terry towelling, terry fabric and cut pile cotton fabric, said material having a ground layer supporting on at least one of its faces, a surface layer of piles. The process comprises:

(a) applying a caustic paste to at least one predetermined area of one of the surface layers of piles;

(b) contacting the material with steam for from about 15 seconds to about 5 minutes; and (c) recovering the material, wherein the shrunken, caustic treated piles are of one color and the unshrunken piles are of a contrasting color.

DESCRIPTION OF THE PREFERRED EMBODIMENTS

As indicated above, the present invention relates to a process for imparting a durable, multiple-level, pile height to a material selected for the group consisting of terry towelling, terry fabric and cut pile cotton fabric.

The material is constructed of a ground layer supporting on at least one of its faces, a surface layer of piles. In a preferred embodiment, the material is constructed of a ground layer positioned between and supporting two surface layers of piles.

The ground layer may be either woven or knitted and comprised of 100% cotton, blends of cotton and other fibers, blended yarns or other suitable yarns. Preferably, it is woven with yarns comprised of 100% cotton or yarns with a high cotton content blended with other natural or man-made fibers.

The surface layer or layers is generally constructed of a plurality of looped piles which have both ends attached to the ground layer. Of course, in the case of cut pile fabrics, a portion or all of the tops of the loops are sheared off to yield a pleasing velour effect. Although the dimensions of the piles may vary widely, they typically have an original height in the range of from about 0.20 to about 0.60 cm and an original diameter in the range of from about 0.15 to about 0.40 cm. Where the material contains two surface layers of piles, the piles of each layer may have the same or different dimensions. For purposes of the present invention, the surface layers are comprised of a major proportion of cotton and are preferably comprised of about 100% cotton yarn.

Depending on the particular desired effects and the process employed, as discussed below, the material may be greige, or may be bleached or dyed according to conventional processes. Exemplary of the dyes which may be used are direct, vat and reactive dyes. Additionally, the material, particularly the pile surfaces thereof, may be subjected to a rewetting agent to facilitate later treatment of the piles. A complete description of the rewetting agents may be found in U.S. Pat. No. 4,108,597, the content of which is incorporated by reference.

According to the process of the present invention, the piles of the surface layer of the material are treated with a caustic paste in at least one predetermined area. Thus, according to the desired pattern, the paste may be either applied in a continuous matrix, such as in stripes or a checkerboard configuration, or in discontinuous areas, such as in dots, circles or in the configuration of an object. In those instances where the material possesses two surface layers of piles, the caustic treatment may be performed on only one surface layer or may be performed on both surface layers, in which case, the pattern on each layer may be the same or different.

Application of the caustic paste may be accomplished by any conventional wet printing technique. Exemplary of such techniques are screen printing and roller printing. Typically, mesh sizes range from about 86 to about 180, which corresponds to a mesh opening of from about 95 to about 180 microns when the thread diameters are in the range of from about 110 to about 185 microns.

The amount of caustic paste applied to the piles generally ranges from about 0.10 to about 0.25 g/cm$^2$, while the viscosity typically ranges from about 1,250 to about 50,000 centipoise when measured by a Brookfield LVF Viscometer using a No. 4 Spindle at 12 r.p.m. at 23° C.

The particular conditions employed for caustic printing a specific material are predominantly determined by the pile dimensions, particularly the pile height. Thus, the pile dimensions determine the quantity and viscosity of the caustic paste. The quantity of the paste applied to the piles is in turn determined by its viscosity, the mesh size and the force of application. Given these general guidelines, it is well within the scope of expertise of those of ordinary skill in the art to adjust the parameters to fit any terry or cut pile material.

After the caustic paste has been applied to the piles of the surface layer, the material is allowed sufficient time for the caustic paste to penetrate and thereby shrink the cotton pile fibers. Under ambient conditions, preferably from about 17° to about 20° C., this time ranges from about 1 to about 5 minutes, preferably from about 3 to about 4 minutes. To facilitate penetration of the paste into the pile fibers, however, the material may be subjected to dry heat (e.g., with moving air in a Benz Heat Transfer Unit or with infrared radiation) at a temperature of from about 105° to about 125° C. for from about 1 to about 5 minutes, preferably from about 1½ to about 2½ minutes. Similarly, steam at a temperature of from about 100° to about 105° C. may be used for from about 15 seconds to about 5 minutes, preferably from about 20 to about 60 seconds.

Besides the temperature at which the material is held during the caustic penetration period, there are other factors that also affect this period. These factors include (a) the viscosity of the caustic paste; (b) the caustic concentration; (c) the physical dimensions and characteristics (e.g., porosity) of the piles; (d) the amount of cotton in the piles; and (e) the amount of caustic paste employed. Of course, the optimum penetration period for an individual set of circumstances may readily be determined by those of ordinary skill in the art. However, in most instances, it will fall within the general ranges disclosed above.

If full shrinkage of an all cotton pile is achieved, there occurs about a 25% reduction in length. Thus, a looped pile 0.5 cm in height would be reduced to 0.375 cm, a difference which is readily discernible to the naked eye.

After the pile fibers have been subjected to the effects of the caustic paste for a time sufficient to achieve the desired degree of shrinking, the material is recovered by techniques well known in the art. Typically, the recovery of the material involves washing the caustic treated material, neutralizing the washed material, rinsing the neutralized material, drying the rinsed material and brushing the dried material. In the event that overdyeing is desired to achieve contrasting color effects, it may be performed either before the drying step or after the material has been brushed.

The formulation of the caustic paste is in great part determined by the particular penetration period conditions employed to obtain shrinkage of the piles and the desired color effects. For example, if the caustic treated material is to be maintained at ambient temperatures (i.e., the "Cold Dwell" process) or subjected to dry heat (i.e, the "Dry Heat" process), the caustic paste is comprised of from about 15 to about 20% of a caustic agent, from about 0.5 to about 4.0% of a thickener and from about 65 to about 85% of water. Unless otherwise indicated, all percentages set forth in the specification are on a weight basis.

The caustic agent may be any alkaline material which is effective in shrinking the piles without causing damage thereto. Illustrative of the caustic agent are potassium hydroxide, lithium hydroxide, and, preferably, sodium hydroxide. Mixtures of these specific compounds may also be employed.

To obtain the proper viscosity of the printing paste, as discussed below, from about 0.5 to about 4.0% of a thicknener is used. The thickener may be any known natural or synthetic substance which can be used to increase the viscosity of the paste, but which does not degenerate or react in the alkaline environment thereof. Typical of the acceptable thickeners are gum arabic, gum tragacanth, dextrine, tapioca flour, and, preferably, "Syngum NCG" (a chemically modified guar based gum) which may be obtained from Stein, Hall and Co., N.Y., N.Y.. Mixtures of such thickeners may also be used.

In those instances where a rewetting agent has not been previously applied to the piles, it may be desirable to incorporate from about 0.01 to about 2.0% of a wetting agent into the caustic paste. In general, the wetting agent must function in an alkaline environment without deterioration and without being "salted out" by the caustic agent. Exemplary of such wetting agents is Wetaid SR Conc. (sodium dioctyl sulfosuccinate) available from C. H. Patrick & Co., Greenville, S.C. A more complete description of the various acceptable thickeners and wetting agents may be found in the aforementioned U.S. Pat. No. 4,108,597.

When the material is to be subjected to steaming, a more alkaline caustic paste is employed due to the diluting effect of the steam. Accordingly, the caustic paste is comprised of from about 27 to about 34% of a caustic agent, from about 0.5% to about 4.0% of a thickener, from about 62 to about 73% of water, and optionally from about 0.01 to about 2.00% of a wetting agent.

The described Cold Dwell, Dry Heat and Steaming processes may be used on bleached material to yield the multiple-level pile height. If the material is then after-dyed using conventional direct, vat or reactive dyes, a material is obtained which has areas of shortened piles which are a darker or different shade than those areas of longer piles that have not been contacted with the caustic paste. The contrast between the respective areas is thus heightened.

Without being limited to any particular theory, it is believed that the caustic paste initially causes the formation of alkali cellulose. This is indicated by the shrinking of the fibers and the attendent increase in breaking strength. Upon neutralization, cellulose hydrate is formed which in turn converts to cellulose II upon drying. This form of cellulose has a larger unit cell and is thus more susceptible to the effects of the dye than the unconverted cellulose.

If a material having shortened piles of a lighter shade than the longer piles is desired, a variation of the Steaming process is used. More specifically, predetermined areas of pre-dyed material are contacted with caustic paste having the above steaming formulation with respect to the caustic agent, the thickener and the wetting agent, but additionally containing from about 0.1 to about 10% of a stripping agent. The percentage of water is proportionally reduced to from about 52 to about 73%. As is known in the art, the stripping agent acts to remove or reduce the color from a fabric by chemical reaction. Typical of such agents are sodium hydrosulfite, zinc formaldehyde sulfoxylate and, preferably, sodium formaldehyde sulfoxylate.

In those instances where it is desired to have areas of shortened piles which are a completely different color from the areas of the longer piles, a further variation of the Steaming process may be employed. In this variation, the printing paste is composed of from about 27 to about 34% of the caustic agent, from about 0.5 to about 4.0% of the thickener, from about 0.01 to about 15% of a dye, from about 0.10 to about 30.0% of a reducing agent, from about 17 to about 73% of water, and optionally from about 0.01 to about 2.00% of a wetting agent.

When vat dyes are employed, the dye and reducing agent react to form the reduced form of the dye. Subsequent steaming, oxidizing, washing and neutralizing produce the desired color on the piles. Although numerous combinations may be utilized, exemplary dyes include Colour Index Vat Yellow 2, CI Vat Orange 2, CI Vat Green 1, CI Vat Brown 1, CI Vat Red 3, CI Vat Blue 6, while exemplary reducing agents include aqueous solutions of ferrous hydroxide (typically made in situ by combining ferrous sulfate and an aqueous solution of calcium hydroxide, i.e., lime water), and calcium hydroxide, hydrogen and, preferably, sodium hydrosulfite. In those instances where the caustic printed material is subjected to heat, particularly by steam, the reducing agent is preferably sodium formaldehyde sulfoxylate.

An important aspect of all of the previously described variations of the present invention is that the areas of pile are shrunk in the absence of substantial shrinkage of the ground layer. The term "substantial" is used to define a situation in which shrinkage of the ground layer cannot be detected by the naked eye. If substantial shrinkage of the ground layer occurs, the material becomes puckered. This is a characteristic that is generally undesirable, particularly in the case of towelling. Moreover, if a paste containing a dye contacts and penetrates the ground layer, the dye may be discerned from the reverse side of the material. This occurrence detracts from the aesthetic appeal of the material, especially where no pattern or a different pattern is desired on the opposite side.

Shrinkage and unwanted dye penetration of the ground layer may be avoided by selecting the viscosity of the paste, the manner of applying the paste, and the penetration period such that the caustic paste does not come into contact with the ground layer. Of course, the individual factors may be varied within wide limits to obtain the same end result. The specific conditions used may readily be determined by routine experimentation which is well within the scope of expertise of those of ordinary skill in the art.

The present invention provides a process for imparting a durable, multiple-level pile height to unbleached, bleached or dyed terry towelling, terry fabric or cut pile cotton fabric. The material possesses excellent hand and absorbency in addition to being aesthetically pleasing. Moreover, where terry towelling is treated, the shrunken piles are firmer and hence exhibit a massaging effect when used to dry the skin. It will also be apparent to those of ordinary skill in the art that variations of the present invention may be used to even further heighten the aesthetic appeal of the material. For example, where two surface layers of piles are present, the reverse side of the material may be similarly treated such that both sides are identical or are contrasting with respect to areas of shrunk pile and/or color. Similarly, various caustic strengths or penetration periods may be used in different areas of the material to yield a true multiple-level pile height. An attractive effect may also be obtained by shearing the loops from the piles of the untreated areas. This yields a material with areas that differ not only in color and height, but also in texture.

The terry towelling, terry fabric and cut pile cotton fabric may be used to form a wide variety of articles. For example, the terry towelling may be used in the creation of a spectrum of towel products which are not only absorbent, but are aesthetically pleasing and possessed of a pleasant "feel". Similarly, the terry fabric can be formed into beachware, bathrobes and baby and sports apparel. In these uses, the terry fabric is particularly useful inasmuch as the piles facing the skin serve to absorb perspiration, yet enable the skin to "breathe". The cut pile cotton fabrics may be used to form towelling, apparel or other end products.

Other variations will become apparent to those of ordinary skill in the art upon reading the following examples. Although the examples show only the treatment of terry towelling, it should be apparent to those of ordinary skill in the art that terry fabric and cut pile cotton fabric may likewise be treated. It should also be understood that the present invention is not limited to the specific details set forth in the examples.

EXAMPLE 1

All-cotton terry towelling, Style 5813, terry ratio 7.44, unit weight finished 1.08 pound (0.49 kilogram), is printed in predetermined areas with a caustic printing paste having the following composition:

| Component | Amount, Grams |
|---|---|
| Water | 1000 |
| "Syngum NCG" | 20 |
| Caustic Soda | 420 |

The viscosity of the paste at 23° C. is 6,625 centipoise using a Brookfield LVF Viscometer with a No. 4 spindle at 12 r.p.m. The paste is applied via a 125 mesh monofilament polyester printing screen having 125–130 micron mesh openings and a 135–140 micron thread diameter. The paste is applied in an amount of 0.15 g/cm$^2$.

After applying the printing paste, the terry towelling is steamed at 100° C. for 60 seconds, washed with water, neutralized with an aqueous 1.0% solution of acetic acid rinsed, and dried at 100° C. The towelling is then scoured and bleached.

The ratio of height of piles in the caustic treated areas to that of piles in areas which are not printed with caustic is 0.8:1.0, which means that the shrunken piles had lost 20% of their original height.

The towelling is not puckered, which shows that the ground layer is not noticeably shrunk. The treated towelling has a good hand and excellent absorbency.

EXAMPLE 2

The procedure of Example 1 is repeated except that the steaming step is replaced with dry heating for 2.5 minutes at 110° C. The results are substantially the same as in Example 1. However, in this instance the heated towelling is completely dry and could be treated as dry goods until it is convenient to continue wet processing (e.g., washing, neutralizing, rinsing, drying and the like). In other words, while it is important that the steamed towelling of Example 1 be washed, neutralized, rinsed and dried promptly after steaming to insure that the final product has a non-shrunken ground layer, the heat treated towelling of this example may be stored until further wet processing is convenient.

EXAMPLE 3

All cotton terry towelling that has been desized, scoured and bleached and dyed that has a unit weight of 17 oz/yd$^2$ is screen printed in predetermined areas with a caustic printing paste having the following composition:

| Component | Amount, Grams |
|---|---|
| Caustic soda | 160 |
| Syngum NCG | 20 |
| Wetaid SR Conc. | 1 |
| Water | 819 |

The viscosity of the paste at 23° C. was 1250 centipoise using the viscometer of Example 1. The paste is applied via an 86 mesh monofilament polyester printing screen having 175–180 micron mesh openings and a 180–185 micron thread diameter. The paste is applied in an amount of 0.15 g/cm$^2$. The printing process is completed in 20 seconds after which time the screen is removed from the towelling. Three minutes at 20° C. are allowed to transpire, during which time the desired shrinking is achieved. The towelling is then washed with hot (80° C.) water, neutralized with acetic acid (1% w/v) at 20° C., washed in cold water and dried at 95° C. The treated towelling has excellent hand and absorbency.

EXAMPLE 4

The procedure of Example 3 is repeated except that:
(1) The composition of the print paste is:

| Component | Amount, Grams |
|---|---|
| Caustic soda | 150 |
| Syngum NCG | 20 |
| Water | 830 |

(2) Dry heating at 115° C. for 3 minutes is used in place of the 3 minutes at 20° C. dwell time.

The results are substantially the same as in Example 3, however, in this case the treated towelling is dry.

EXAMPLE 5

The procedure of Example 3 is repeated except that:
(1) The compostion of the print paste is:

| Component | Amount, Grams |
|---|---|
| Caustic soda | 300 |
| Syngum NCG | 20 |
| Water | 680 |

The viscosity of this solution at 23° C. is 36,750 centipoise using the aforementioned viscometer.

(2) Steaming at 105° C. for 60 seconds is used in place of the 3 minutes at 20° C. dwell time.

The results obtained are substantially the same as in Example 3.

EXAMPLE 6

The procedure of Example 3 is repeated except that:
(1) The composition of the print paste is:

| Component | Amount, Grams |
|---|---|
| Caustic soda | 300 |
| Syngum NCG | 20 |
| Sodium formaldehyde sulfoxylate | 5 |
| Water | 675 |

(2) Steaming at 105° C. for 60 seconds is used in place of the 3 minutes at 20° C. dwell time.

As far as reduction in pile length and characteristics of the finished towelling are concerned, the results obtained are substantially the same as in Example 3. However, the effect of the stripping agent is to partially remove the existing color. Consequently, the visual effect is quite different from that achieved in Example 3.

EXAMPLE 7

All cotton terry towelling that has been desized, scoured and bleached and that has a unit weight of 17 oz/yd$^2$ is screen printed in predetermined areas with a caustic printing paste having the following composition:

| Component | Amount, Grams |
|---|---|
| Caustic soda | 30 |
| syngum NCG | 1 |
| Vat Red 10 | 0.05 |
| Sodium hydrosulfite | 8 |
| Water | 60 |

The paste is applied via an 86 mesh monofilament polyester printing screen having 175–180 micron mesh openings and a 180–185 micron thread diameter. The paste is applied in an amount of 0.15 g/cm$^2$. The printing process is completed in 20 seconds after which time the screen is removed from the towelling. The towelling is contacted with steam at 105° C. for 60 seconds to ensure adequate penetration of the dye. Upon completion of the steaming step, the towelling is washed with hot (80° C.) water, neutralized with acetic acid (1% w/v) at 20° C., washed in cold water and dried at 95° C.

The treated towelling has excellent hand and absorbency and exhibits treated areas that are of a contrasting color compared to the untreated areas.

EXAMPLE 8

The procedure of Example 7 is repeated except that 0.15 grams of Hostavat Yellow 3 RT is used as the dye. The treated towelling again has excellent hand and absorbency and exhibits treated areas that are a contrasting color compared to the untreated areas.

Although the invention has been described with preferred embodiments, it is to be understood that variations and modifications may be resorted to as will be apparent to those skilled in the art. These variations and modifications are to be considered within the scope of the following claims.

We claim:

1. A process for imparting a durable, multiple-level, pile height to bleached, unbleached or dyed material selected from the group consisting of terry towelling, terry fabric and cut pile cotton fabric, said material having a ground layer supporting a surface layer of piles on at least one of its faces, said process comprising:

(a) applying a caustic paste to at least one predetermined area of one of the surface layers of piles;

(b) allowing the caustic paste sufficient time to shrink the piles in said at least one predetermined area in the absence of substantial shrinkage of the ground layer; and (c) recovering the material, said process further being characterized in that the paste viscosity, the manner of applying the paste, and the time are selected effectively to shrink the piles without contacting said ground layer.

2. The process of claim 1 wherein the caustic paste comprises from about 15 to about 20% of a caustic agent, from about 0.5 to about 4.0% of a thickener and from about 65 to about 85% of water, all percentages being on a weight basis.

3. The process of claim 2 wherein the caustic treated material is allowed to stand at ambient temperature for from about 1 to about 5 minutes.

4. The process of claim 2 wherein the caustic treated material is heated to a temperature of from about 105° C. to about 125° C. for from about 1 to about 5 minutes.

5. The process of claim 1 wherein the caustic treated material is contacted with steam for from about 15 seconds to about 5 minutes.

6. The process of claim 5 wherein the caustic paste comprises from about 27 to about 34% of a caustic agent, from about 0.5 to about 4.0% of a thickener, from about 0.1 to about 30.0% of a reducing agent, from about 0.01 to about 15% of a vat dye and from about 17 to about 73% of water, all percentages being on a weight basis.

7. The process of claim 1 wherein the material is terry towelling having two surface layers of piles each comprised of about 100% by weight of cotton.

8. The process of claim 7 wherein step (c) comprises washing the caustic treated material, neutralizing the washed material, rinsing the neutralized material, drying the rinshed material and brushing the dried material.

9. A process for imparting a durable, multiple-level, multiple-color, pile height to bleached or dyed material selected from the group consisting of terry towelling, terry fabric and cut pile cotton fabric, said material having a ground layer supporting a surface layer of piles on at least one of its faces, said process comprising:

(a) applying a caustic paste to at least one predetermined area of one of the surface layers of piles;

(b) contacting the material with steam for from about 15 seconds to about 5 minutes; and (c) recovering the material;

wherein the shrunken, caustic treated piles are of one color and the unshrunken piles are of a contrasting color, said process further being characterized in that the paste viscosity, the manner of applying the paste, and the time are selected effectively to shrink the piles without contacting the ground layer.

10. The process of claim 9 wherein the caustic paste is comprised of from about 27 to about 34% of a caustic agent, from about 0.5 to about 4.0% of a thickener, from about 0.1 to about 10% of a stripping agent and from about 52 to about 73% of water, all parts being on a weight basis.

11. The process of claim 9 wherein the material is terry towelling having two surface layers of piles each comprised or about 100% by weight of cotton.

12. The process of claim 11 wherein step (c) comprises washing the caustic treated towelling, neutralizing the washed towelling, rinsing the neutralized towelling, drying the rinsed towelling and brushing the dried towelling.

* * * * *